United States Patent [19]

Makino et al.

[11] Patent Number: 4,635,403

[45] Date of Patent: Jan. 13, 1987

[54] EDGE ROUNDING MACHINE

[75] Inventors: Masashi Makino, Toyonaka; Kunio Nakada, Suita; Isao Muragishi, Osaka; Syōzi Nishitani, Higashiosaka, all of Japan

[73] Assignee: Matsushita Electric Industrial Co., Ltd., Osaka, Japan

[21] Appl. No.: 743,970

[22] Filed: Jun. 12, 1985

[51] Int. Cl.[4] ..... B24B 9/00

[52] U.S. Cl. ..... 51/94 R; 51/95 R; 51/97 R; 51/234

[58] Field of Search ..... 51/91 R, 94 R, 95 R, 51/96, 97 R, 154, 145 R, 141, 62, 98.5, 328, 283 E, 284 E, 229, 234

[56] References Cited

U.S. PATENT DOCUMENTS

| | | | |
|---|---|---|---|
| 1,541,136 | 6/1925 | Gunn | 81/9.3 |
| 2,312,400 | 3/1943 | Govanus | 81/9.3 |
| 3,258,040 | 6/1966 | Evans | 81/9.3 |
| 3,321,871 | 5/1967 | Balamuth et al. | 51/262 R |
| 3,468,067 | 9/1969 | Larson | 51/96 |
| 3,668,814 | 6/1972 | Freerks et al. | 51/145 R X |
| 4,216,628 | 8/1980 | Wada | 51/98.5 |
| 4,461,121 | 7/1984 | Motzer et al. | 51/3 |
| 4,520,595 | 6/1985 | Diener | 51/3 |

FOREIGN PATENT DOCUMENTS

| | | | |
|---|---|---|---|
| 1442101 | 7/1976 | United Kingdom | 51/145 T |

*Primary Examiner*—Frederick R. Schmidt
*Assistant Examiner*—Debra S. Meislin
*Attorney, Agent, or Firm*—Wenderoth, Lind & Ponack

[57] ABSTRACT

An edge rounding machine for performing edge rounding of an outer edge portion of a machining face of a workpiece such as a floppy disk head, etc., including a cylindrical rotary member having, at its outer periphery, cutting edges, a holder for supporting the workpiece such that the machining face of the workpiece is brought into contact, at the outer edge portion, with a grinding face of the cylindrical rotary member at an angle, a rotary device for rotating the workpiece about its rotary centerline perpendicular to the machining face, a pivotal device for pivoting the workpiece, a support member for retractably guiding the holder along the rotary centerline of the workpiece, and an urging device for urging the workpiece towards the grinding face.

8 Claims, 19 Drawing Figures

EDGE ROUNDING MACHINE

This application is related to copending Ser. No. 726,378 filed on Apr. 23, 1985 in the names of the same inventors.

BACKGROUND OF THE INVENTION

The present invention generally relates to chamfering or edge rounding machines and more particularly, to an edge rounding machine for rounding edges of a floppy disk head or the like.

As shown in FIG. 1, a floppy disk head (workpiece) A is made of fragile material such as ceramics, etc. and is substantially formed into a rectangular parallelopiped shape. The floppy disk head A has a machining face 1 confronting a floppy disk (not shown). In order to prevent the floppy disk from being damaged by the machining face 1, an outer edge portion 2 of the machining face 1 is subjected, throughout its periphery, to curved chamfering or edge rounding. Thus, the machining face 1 has a flat portion 3, a curved chamfered portion or an edge-rounded portion 2*a* and a boundary 2*b* between the flat portion 3 and the edge-rounded portion 2*a*. The boundary 2*b* is required to be machined smoothly with high precision.

A prior art edge rounding machine for performing such edge rounding with high precision is shown in FIGS. 2 and 3*a*. The known edge rounding machine includes a grinding device 6. The grinding device 6 is provided with a rotary disk 14, an elastic sheet 4 and a grinding sheet 5 secured, through the elastic sheet 4, to an upper face of the rotary disk 14. Meanwhile, the workpiece A is rotated, pivoted and, at the same time, urged towards a grinding face 7 of the grinding device 6 along a rotary axis P′ of the workpiece A so as to be subjected, in pressing contact with the grinding face 7 of the grinding sheet 5, to edge rounding. The known edge rounding machine further includes three holders 8 each for holding the workpiece A and a motor 9 for rotating the holders 8. The holders 8 are driven by the motor 9 so as to be each rotated about the rotary axis P′ such that the workpieces A are each rotated about the rotary axis P′. The holders 8 are mounted on an end portion 10 of an L-shaped pivotal arm 12 so as to be each pivoted through a predetermined angle $\alpha'$ in response to pivotal movements of the pivotal arm 12. As a result, the workpieces A are pivoted about a pivotal centerline Q′. Reference numeral 13 represents a crank mechanism for pivoting the pivotal arm 12.

Furthermore, the holders 8 are axially movably supported by the end portion 10 of the pivotal arm 12 and are each urged downwardly by a spring 11. As a result, the workpieces A are each urged towards the grinding face 7 along the rotary axis P′ so as to be brought into pressing contact with the grinding face 7. Since the known edge rounding machine is provided with three holders 8 mounted on the end portion 10 of the pivotal arm 12 as described above, three workpieces A can be machined simultaneously by the known edge rounding machine.

The prior art edge rounding machine of the above described arrangement has the following drawbacks (1) to (4).

(1) In the known edge rounding machine, when the workpiece A is disposed at a pivotal position most adjacent to a vertical line V′ as shown by imaginary lines in FIG. 3*a*, the outer edge portion 2 of the machining face 1 to be subjected to edge rounding is machined into the edge-rounded portion 2*a* having an oblique curved surface. At this time, since the elastic sheet 4 disposed between the rotary disk 14 and the grinding sheet 5 is properly deformed elastically, an angle $\theta$ (FIG. 1) of inclination of the oblique curved surface of the edge-rounded portion 2*a* can be minimized, so that the edge-rounded portion 2*a* can be smoothly connected, at the boundary 2*b*, with the flat portion 3. Accordingly, when proper elastic deformation of the elastic sheet 4 is prevented due to its initial nonuniformity in coefficient of elasticity, surface hardness, etc. or change of its physical properties with time, it is impossible to smoothly connect, at the boundary 2*b*, the edge-rounded portion 2*a* and the flat portion 3. Furthermore, a problem arises in that since the angle $\theta$ of inclination varies due to change of coefficient of elasticity of the elastic sheet 4, quality of the finished product of the workpiece A becomes unstable.

(2) In the known edge rounding machine, if the workpiece A is pivoted in opposite directions from the vertical line V′, the flat portion 3 of the machining face 1 is brought into contact with the grinding face 7 of the grinding sheet 5, so that scratches are produced on the surface of the flat portion 3. In order to obviate such inconvenience, it is arranged (as shown in FIG. 3*a*) such that the workpiece A is pivoted only in one direction with respect to the vertical line V′ so as to be subjected to edge rounding. However, in this case, a problem is encountered in that the boundary 2*b* between the flat portion 3 and the edge-rounded portion 2*a* is obliquely deviated from the ideal line i as shown in FIG. 3*b*, thereby resulting in deterioration of the quality of the finished product of the workpiece A.

(3) Generally, profiles of the curved surfaces of the edge-rounded portions 2*a* of floppy disk heads are differently standardized according to the types of machines to be equipped with the floppy disk heads, respectively. Thus, in order to deal with various floppy disk heads formed with the edge-rounded portions 2*a* whose curved surfaces have different profiles, various kinds of elastic sheets 4 are required to be prepared therefor. In addition, each time the type and size of the workpieces A is changed, it is necessary to select a suitable elastic sheet 4 or determine optimum machining conditions of the workpieces A on a trial and error basis.

(4) When a plurality of the workpieces A are simultaneously subjected to edge rounding as shown in FIG. 2, respective grinding portions of the grinding sheet 5 have different circumferential speeds. Therefore, the finished products of the workpieces A vary in quality.

SUMMARY OF THE INVENTION

Accordingly, an essential object of the present invention is to provide an improved edge rounding machine which eliminates the above described disadvantages inherent in conventional edge rounding machines of this kind.

In order to accomplish this object of the present invention, an edge rounding machine according to the present invention, in a first aspect of the present invention, employs as a grinding device a cylindrical rotary member having, at its outer periphery, cutting edges, e.g., a cylindrical grinding wheel or a grinding tape unit constituted by a rotating drum and a grinding tape wound around the rotating drum.

In a second aspect of the present invention, the edge rounding machine includes a holder for holding a workpiece. The workpiece is held by the holder such that a machining face of the workpiece is angularly brought into contact, at its outer edge portion, with a grinding face of the cylindrical rotary member or a curved grinding face of the grinding tape whose inner face is supported by the rotating drum.

In a third aspect of the present invention, the edge rounding machine includes a rotary device for rotating the holder so as to rotate the workpiece about its rotary centerline perpendicular to the machining face of the workpiece, a pivotal means for pivoting the holder in a plane which not only contains the rotary centerline of the workpiece but is parallel to a rotary axis of the cylindrical rotary member, a support member for retractably guiding the holder along the rotary centerline of the workpiece, and an urging means for urging the holder towards the grinding face so as to hold the outer edge portion of the machining face of the workpiece in contact with the grinding face at all times. The edge rounding machine of the present invention is fundamentally arranged to perform edge rounding of the workpiece on the rigid cylinder as described above. Thus, it becomes possible to determine the profile of the curved surface of the edge-rounded portion of the workpiece and machining accuracy of the workpiece on the basis of geometrical positional relation between the grinding device and the workpiece. Consequently, in accordance with the present invention, it is possible to obtain a finished product of stable quality having an oblique curved surface machined with high precision in contrast with the prior art edge rounding machines based on elastic deformation of the elastic sheet referred to earlier.

BRIEF DESCRIPTION OF THE DRAWINGS

The objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
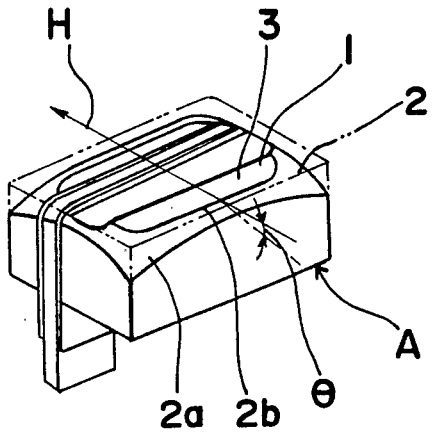
FIG. 1 is a perspective view of a floppy disk head as one example of a workpiece to which the present invention may be applied (already referred to)
Figure 2:
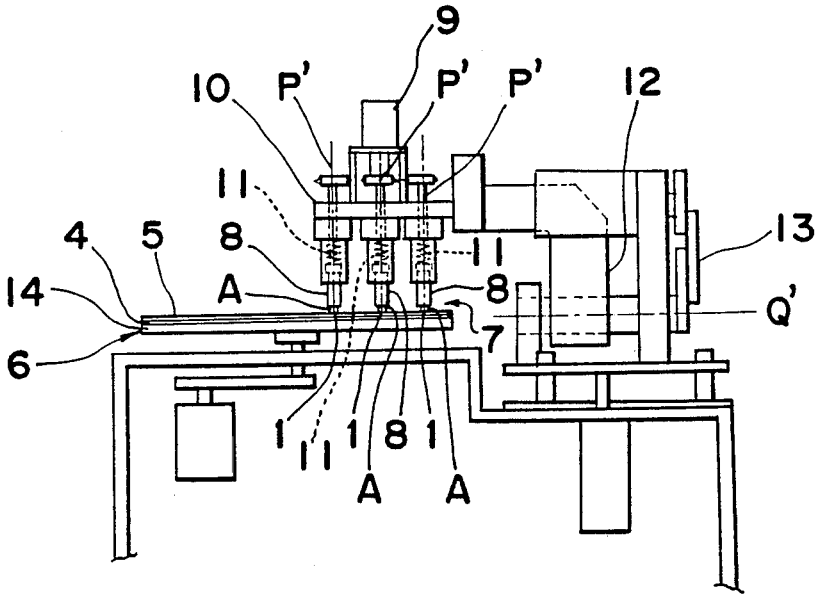
Fig. 2 PRIOR ART
FIG. 2 is a side elevational view of a prior art edge rounding machine (already referred to)

Referring now to the drawings, there is shown in FIGS. 4 to 10, an edge rounding machine K1 according to a first embodiment of the present invention. The edge rounding machine K1 includes a cylindrical rotary member having, at its outer periphery, cutting edges, for example, a cylindrical grinding wheel 15. It is to be noted that a grinding sheet bonded around an outer periphery of a rotating drum can be employed in place of the cylindrical grinding wheel 15 as will be described later. It should be further noted that arrow X, Y and Z in FIGS. 4 to 10 denote directions of X-axis, Y-axis and Z-axis of a three-dimensional coordinate system established with respect to the edge rounding machine K1, respectively.

The cylindrical grinding wheel 15 is rotatably and horizontally supported by a bearing unit 16 mounted on a machine base 60. The cylindrical grinding wheel 15 is driven for rotation thereof by a motor 18 through a belt 17. A reversible motor is preferably employed as the motor 18 so as to enable forward and reverse rotations of the cylindrical grinding wheel 15. A coating liquid 52 such as olive oil, turpentine oil, water, etc. is applied to the cylindrical grinding wheel 15. To this end, the edge rounding machine K1 includes a a plurality of, for example, three coaters 50 each for supplying, via a feed pipe 51, the coating liquid 52 to a grinding face g of the cylindrical grinding wheel 15. The edge rounding machine K1 further includes a sponge roller 53. The sponge roller 53 is held in contact with the grinding face g of the cylindrical grinding wheel 15 so as to spread the coating liquid 52 over the grinding face g such that the coating liquid 52 is uniformly applied to the grinding face g. In order to improve machining accuracy of the profile of an edge-rounded portion of a workpiece A, the cylindrical grinding wheel 15 is so formed as to have a cylindricality or change in diameter of not more than 1 μm/100 mm. Furthermore, in order to repress vibration of the cylindrical grinding wheel 15 due to eccentricity in weight and reduce resonance of the workpiece A in response to vibration of the cylindrical grinding wheel 15, the workpiece A is finished to a surface roughness of not more than 1 μm.

Furthermore, the edge rounding machine K1 includes a holder unit 20 and an X-axis table 44. The holder unit 20 is arranged not only to hold the workpiece A but to rotate the workpiece A about its rotary axis, which coincides with the rotation axis P of the holder, the axis P lying in a plane which is parallel to a rotary axis S of the grinding wheel, pivot the workpiece A and urge the workpiece A in the direction of the rotary axis of the workpiece A. The holder unit 20 is movably provided on the machine base 60 so as to be moved in the horizontal directions of the X-axis, the Y-axis and the vertical direction of the Z-axis, which directions are oreinted at right angles to one another. Meanwhile, the X-axis table 44 is guided by a pair of X-axis guides 43 mounted on the machine base 60 so as to be moved in a direction parallel to a rotary axis S (FIG. 7) of the cylindrical grinding wheel 15, i.e., in the direction of the X-axis. More specifically, the X-axis table 44 is moved in the direction of the X-axis in threaded engagement with a feed screw 45 driven by a motor 49. The feed screw 45 is supported by bearing brackets 47 and 48 confronting each other. Since accuracy of horizontal travel of the X-axis table 44 seriously affects machining accuracy of the profile of the edge-rounded portion of the workpiece A, the X-axis table 44 is arranged to travel with a deviation of not more than 5 μm from an ideal horizontal travel path in the case of a travel distance of 300 mm, which deviation is measured in the upward and downward directions and the sidewise direction of the edge rounding machine K1.

Moreover, the edge rounding machine K1 includes a Y-axis table 27 and a Z-axis block 30. The Y-axis table 27 is guided by a pair of Y-axis guides 26 mounted on the X-axis table 44 so as to be moved in directions towards and remote from the cylindrical grinding wheel 15, i.e., in the direction of the Y-axis. The Y-axis table 27 is positioned in the direction of the Y-axis by a micro head 28 secured to the X-axis table 44. A tension spring 29 is attached to the Y-axis table 27 so as to eliminate play of the Y-axis table 27 in the direction of the Y-axis such that the Y-axis table 27 is accurately positioned in the direction of the Y-axis. Meanwhile, the Z-axis block 30 is guided by a pair of Z-axis guides 40 standing on the Y-axis table 27 so as to be moved in the upward and downward directions of the edge rounding machine K1, i.e., in the direction of the Z-axis. More specifically, in response to forward and reverse rotations of a high rotor 42 for rotating an end cam 41, the Z-axis block 30 is moved upwardly and downwardly in the direction of the Z-axis through the end cam 41.

The above described holder unit 20 includes an L-shaped pivotal arm 19, a bearing member 23 secured to an end portion of the pivotal arm 19, a rotary cylinder means 22 such as, a holder or chuck 21 for holding the workpiece A, and a spring 61 (FIG. 8) for urging the holder 21 downwardly. The rotary cylinder 22 is rotatably but axially nonmoveably supported by the bearing member 23. The holder 21 is axially movably supported by the rotary cylinder 22 so as to be rotated together with the rotary cylinder 22 in response to rotation of the rotary cylinder 22. The pivotal arm 19 is pivotally supported, at its base portion, by the Z-axis block 30 functioning also as a bearing of the pivotal arm 19. A shaft 31, having a center axis which is orthogonal to the rotary axis S of the grinding wheel 15, is extended through a bore of the Z-axis block 30 in the direction of the Y-axis so as to be rotatably supported by the Z-axis block 30. The base portion of the pivotal arm 19 is secured to one end of the shaft 31, while a pivotal lever 32 is fixed to the other end of the shaft 31 by using a bolt 33. The pivotal lever 32 is coupled with one end of a connecting rod 34, while the other end of the connecting rod 34 is held in contact with a cam 37 through a cam follower 36. In response to rotation of the cam 37, the connecting rod 34 is displaced rightwards and leftwards in FIG. 6, so that the pivotal lever 32, i.e., the pivotal arm 19 is pivoted about a pivotal centerline Q identical with the axis of the shaft 31. The cam 37 is driven for rotation thereof at a predetermined reduction ratio by a motor 38. A tension spring 39 is provided for eliminating play of a pivotal mechanism including the pivotal lever 32.

Figure 4:
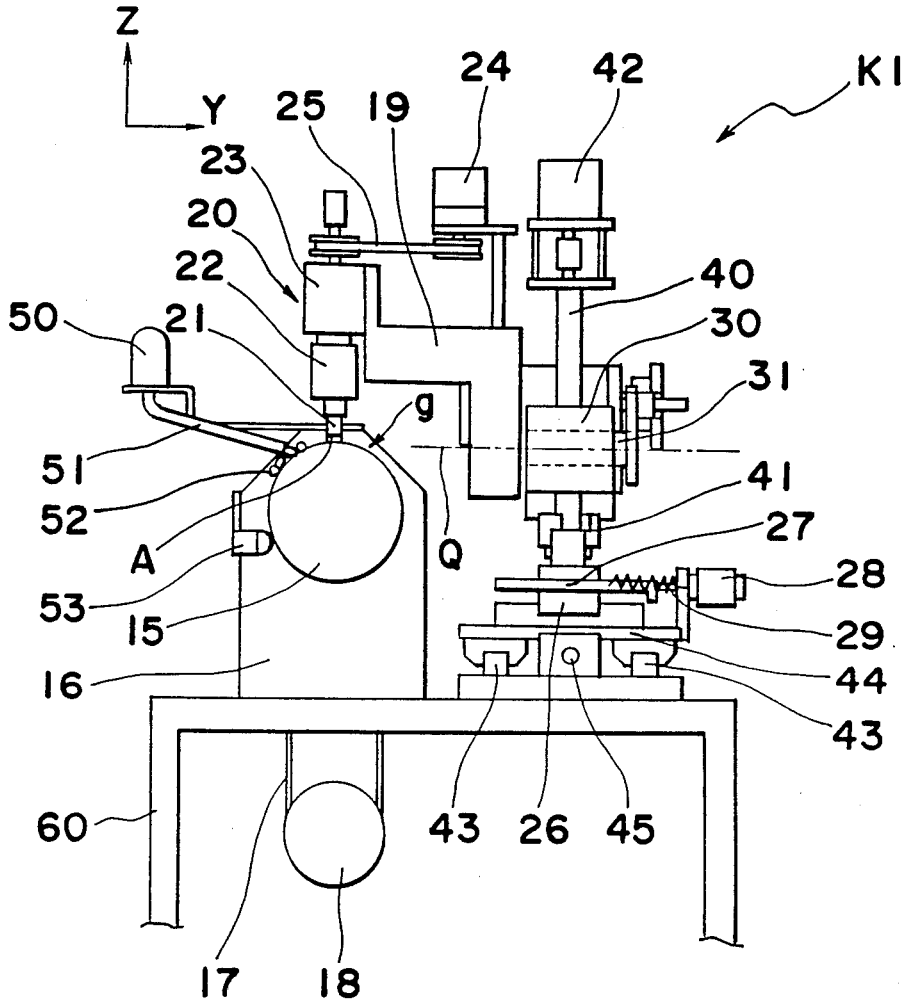
FIG. 4 is a side elevational view of an edge rounding machine according to a first embodiment of the present invention.
Figure 5:
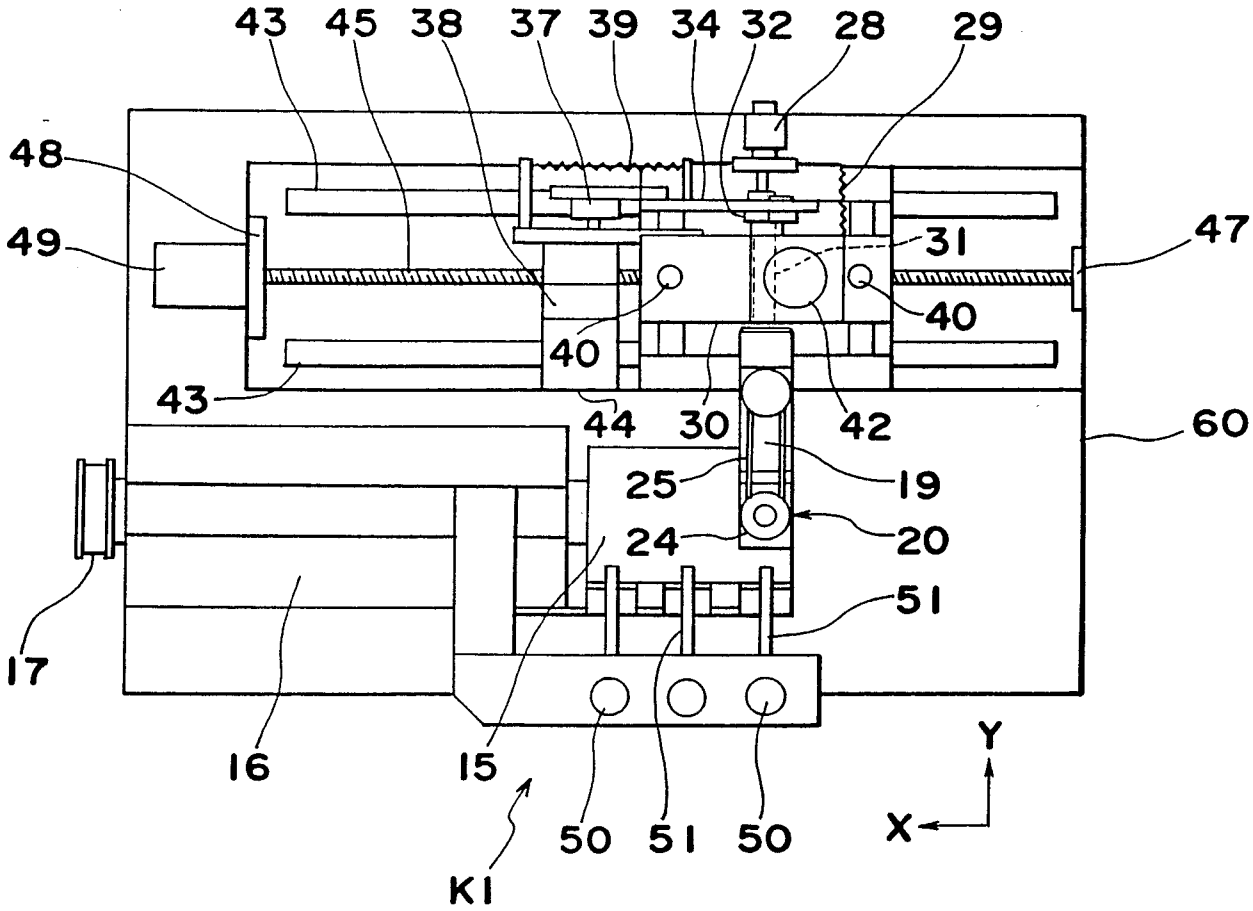
FIG. 5 is a top plan view of the edge rounding machine of FIG. 4.
Figure 6:
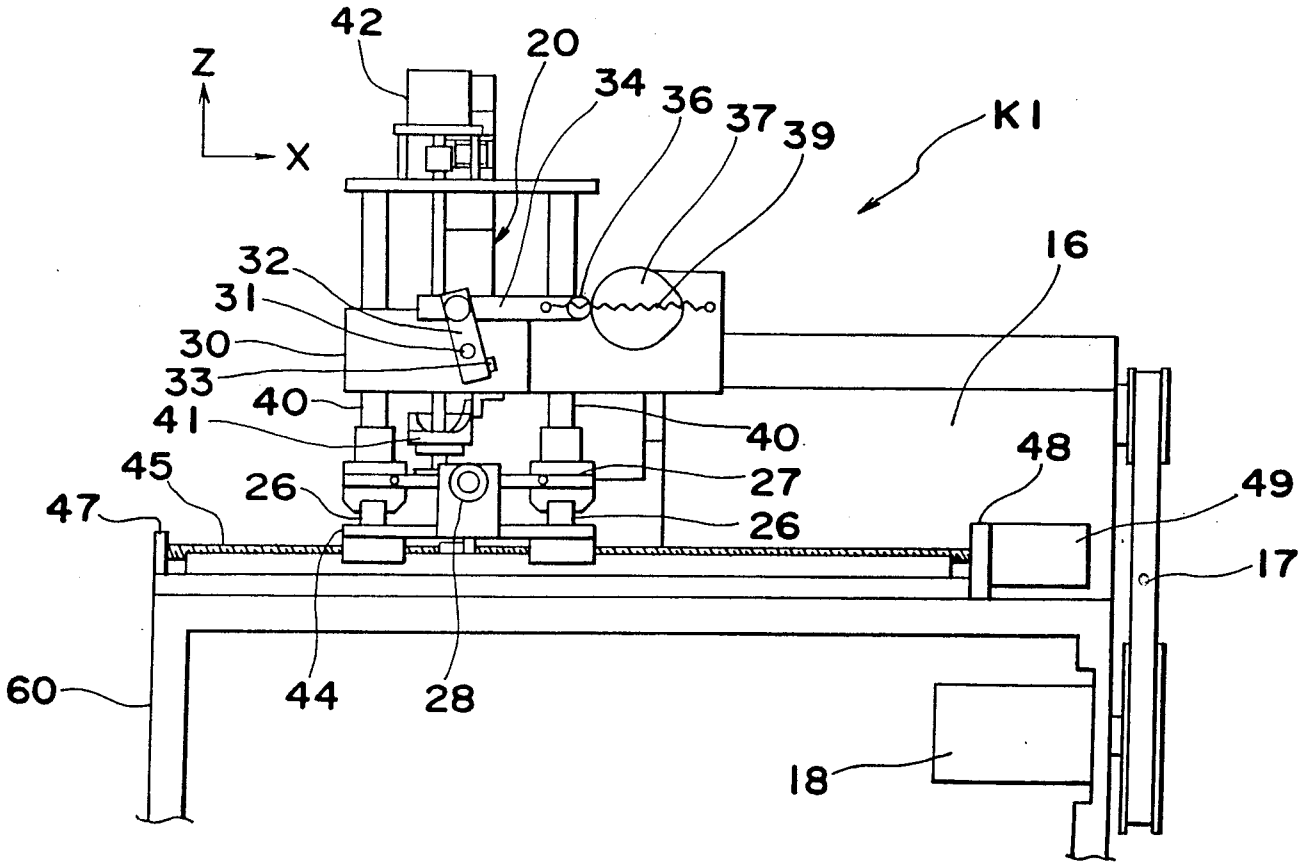
FIG. 6 is a rear elevational view of the edge rounding machine of FIG. 4.
Figure 8:
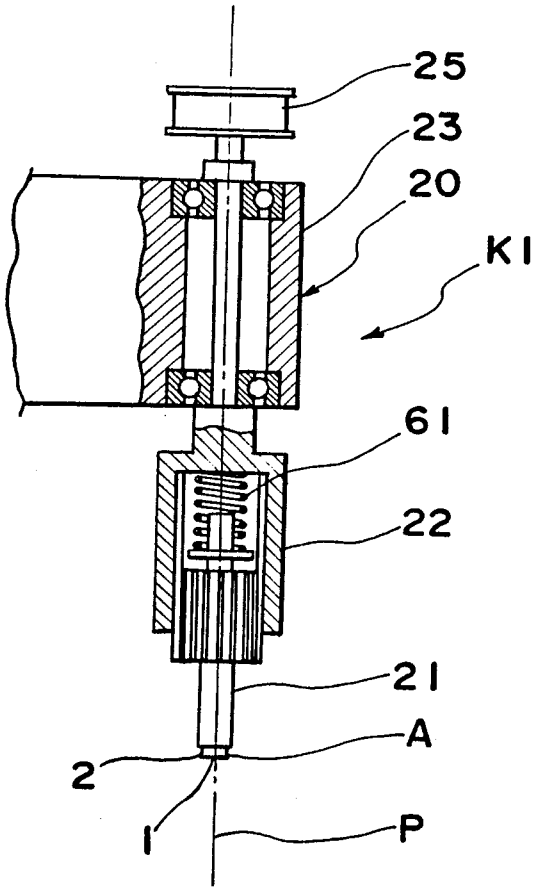
FIG. 8 is an enlarged fragmentary front elevational view partly in section of the edge rounding machine of FIG. 4.
Figure 7:
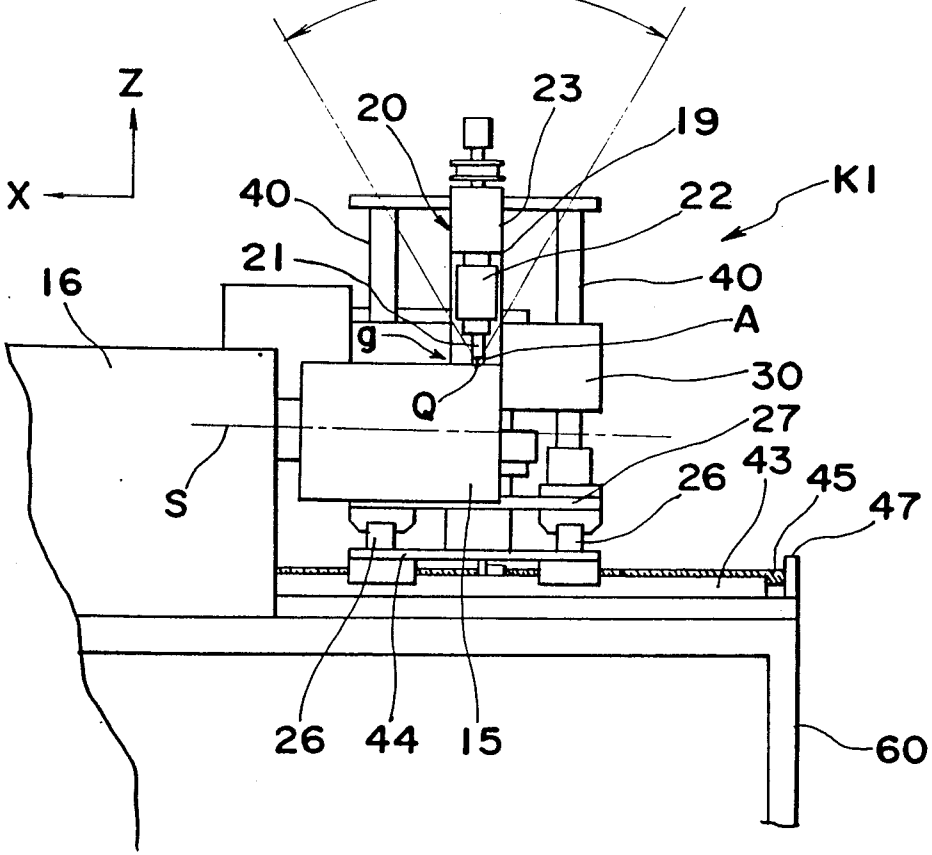
FIG. 7 is a fragmentary front elevational view of the edge rounding machine of FIG. 4.

As shown in FIG. 4, the rotary cylinder 22 is driven by a motor 24 through a timing belt 25 so as to rotate the holder 21 such that the workpiece A is rotated at a speed of, preferably, 100 to 500 rpm. As shown in FIG. 8, the holder 21 is axially movably supported by the rotary cylinder 22 through a spline and is rotated together with the rotary cylinder 22 in response to rotation of the rotary cylinder 22. Furthermore, the holder 21 is urged or biasing downwardly by the spring 61 disposed between the holder 21 and the rotary cylinder 22. The workpiece A is detachably supported, at a lower end portion of the holder 21, by the holder 21. The workpiece A is supported by the holder 21 such that a machining face 1 of the workpiece A is oriented downwardly, with the machining face 1 being directed at right angles to the centerline P of the holder 21.

Figure 10:
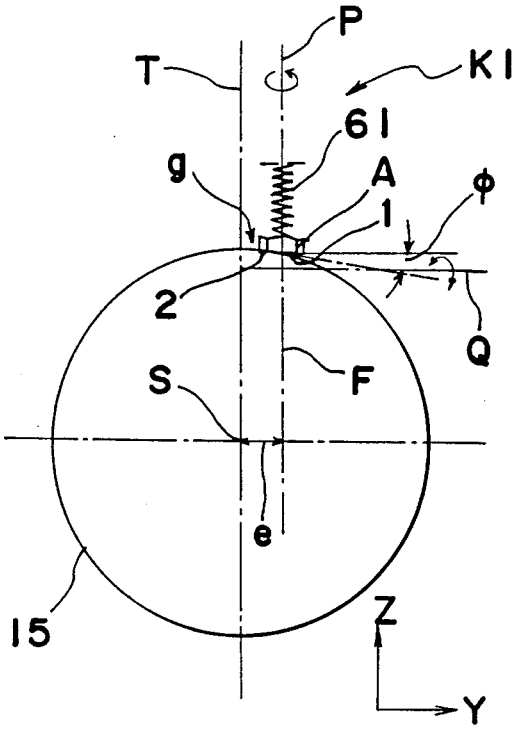
FIG. 10 is a front elevational view of the grinding wheel of FIG. 9.

The holder 21 is accurately positioned in the direction of the Y-axis by adjusting the micro head 28. As shown in FIG. 10, when the workpiece A is subjected to edge rounding, the holder 21 is positioned such that an offset e is produced between the centerline P of the holder 21 and the centerline T of the cylindrical grinding wheel 15. As a result, the machining face 1 of the workpiece A is brought into contact, at its outer edge portion 2, with the grinding face g of the cylindrical grinding wheel 15 at an angle $\phi$. By setting the offset e, i.e., the angle $\phi$ at a proper value, it becomes possible to obtain a desired angle $\theta$ of inclination at the oblique curved surface of the edge-rounded portion on the machining face 1 of the workpiece A and a desired profile of the oblique curved surface on the machining face 1 of the workpiece A.

Figure 9:
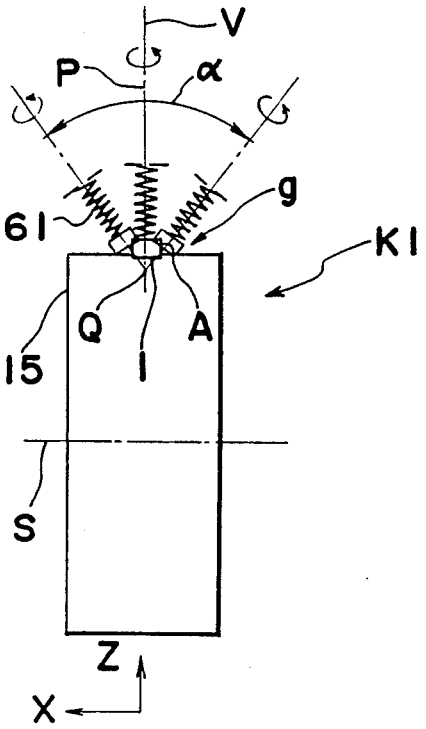
FIG. 9 is a side elevational view of a grinding wheel employed in the edge rounding machine of FIG. 4.

The workpiece A is rotated about the centerline P, which is perpendicular to the machining face 1. Any known rotary device can be, needless to say, employed for rotating the workpiece A in place of the above described one. As shown in FIG. 9, the holder 21, i.e., the workpiece A is pivoted about the pivotal centerline Q in a plane which not only contains the centerline P but is parallel to the rotary axis S of the cylindrical grinding wheel 15. In this embodiment, the pivotal centerline Q is disposed below the machining face 1 into the cylindrical grinding wheel 15. Furthermore, it is so arranged that the workpiece A is displaced through a half of its pivotal angle $\alpha$ symmetrically with respect to a vertical line V extending through the pivotal centerline Q so as to be pivoted through the pivotal angle $\alpha$ about the pivotal centerline Q. The pivotal angle $\alpha$ of the workpiece A can be arbitrarily set at, for example, 80° by properly changing the profile and size of the cam 37.

Meanwhile, a pivotal speed of the holder 21 seriously affects machining accuracy of the workpiece A and is preferably set at 50 to 70 sec/cycle. In order to pivot the holder 21, any other known means such as a crank mechanism, etc. can be employed in place of the above described cam mechanism. The holder 21 is retractably guided by the rotary cylinder 22 so as to be displaced along the centerline P. Since machining accuracy of the holder 21 greatly affects edge rounding accuracy of the workpiece A, the holder 21 is machined to a radial deviation of not more than 5 μm. A member other than the rotary cylinder 22 can be employed for guiding the holder 21. For example, it can be also so arranged that the bearing member 23 retractably guides the rotary cylinder 22 having the holder 21 secured thereto. The holder 21 is urged towards the grinding face g of the cylindrical grinding wheel 15 by the spring 61 such that the outer edge portion 2 of the machining face 1 of the workpiece A is at all times held in contact with the grinding face g. The spring 61 can be replaced by a pneumatic device or a hydraulic device.

Hereinbelow, operations of the edge rounding machine K1 of the above described arrangement will be described. Initially, after the X-axis table 44 has been displaced to a position far distant from the cylindrical grinding wheel 15, the workpiece A is attached to the holder 21 with a force sufficient to prevent the workpiece A from falling off the holder 21 during machining of the workpiece A. Meanwhile, the Y-axis table 27 is positioned by adjusting the micro head 28 such that the offset e is set at, for example, 1 to 10 mm in the case where the cylindrical grinding wheel 15 has a diameter of 210 mm. At this time, the Z-axis block 30 is raised upwardly. Subsequently, the X-axis table 44 is displaced to a predetermined position in the direction of the X-axis and the Z-axis block 30 is lowered to a predetermined position in the direction of the Z-axis such that the outer edge portion 2 of the workpiece A is brought into pressing contact with the grinding face g of the cylindrical grinding wheel 15. The coating liquid 52 is supplied to the grinding face g of the cylindrical grinding wheel 15.

Immediately before the workpiece A is brought into contact with the cylindrical grinding wheel 15, the holder 21, i.e., the workpiece A is rotated about the centerline P and, at the same time, pivoted about the pivotal centerline Q. While the workpiece A is being rotated, pivoted and urged towards the grinding face g, the workpiece A is subjected, at the outer edge portion 2 of the machining face 1, to edge rounding. After completion of one cycle of pivotal movements of the workpiece A, the Z-axis block 30 is raised such that the workpiece A is spaced away from the cylindrical grinding wheel 15. Then, after pivotal movements and rotation of the workpiece A have been stopped, the X-axis table 44 is returned to its original position. Thus, upon lapse of a preset time period, edge rounding of the workpiece A is completed and then, the finished product of the workpiece A is taken away from the edge rounding machine K1. When the next workpiece A is machined by the edge rounding machine K1, a machining position of the X-axis table 44 is slightly deviated from that for the previous workpiece A. Thus, since a grinding position of the grinding face g is also slightly deviated from that for the previous workpiece A in the direction of the X-axis, such an advantage is brought about that the cylindrical grinding wheel 15 wears uniformly.

The edge rounding machine K1 of the above described arrangement produces the following effects (1) to (3).

(1) Edge rounding performed by the edge rounding machine K1 is fundamentally a grinding operation on the rigid cylinder. Thus, since the profile of the curved surface of the edge-rounded portion of the workpiece A and machining accuracy of the edge-rounded portion of the workpiece A are determined by geometrical position of the workpiece A relative to the cylindrical grinding wheel 15, the profile of the curved surface of the edge-rounded portion of the workpiece A is stabilized in contrast with the prior art edge rounding machines based on elastic deformation of the elastic sheet referred to earlier. Consequently, quality of the finished product becomes stable and machining accuracy of the workpiece A can be improved.

Figure 3A:
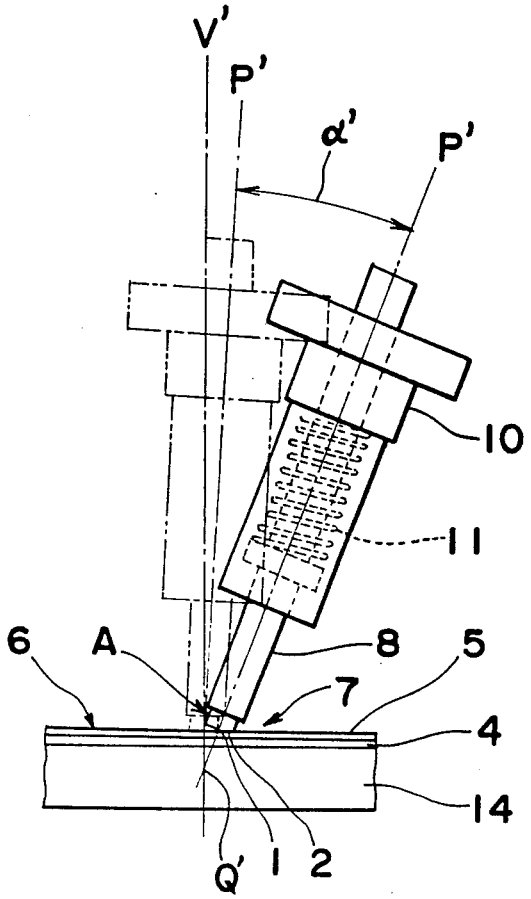
Fig. 3a PRIOR ART
FIG. 3*a* is an enlarged fragmentary front elevational view of the prior art edge rounding machine of FIG. 2 (already referred to)
Figure 3B:
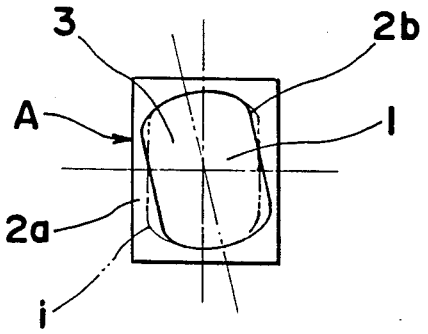
Fig. 3b PRIOR ART
FIG. 3*b* is a top plan view of the floppy disk head of FIG. 1 machined by the prior art edge rounding machine of FIG. 2.

(2) Since the machining face 1 of the workpiece A is brought into contact with the grinding face g of the cylindrical grinding wheel 15 at the angle $\phi$, it becomes possible to positively prevent machining traces or scratches from being produced on a flat portion 3 of the machining face 1. As a result, a finished product of high quality can be obtained. Furthermore, since edge rounding of the workpiece A can be performed by pivoting the workpiece A in opposite directions from the vertical line V in FIG. 9, the finished product of high quality having the edge-rounded portion formed into the profile of the ideal line i (FIG. 3*b*) can be obtained.

(3) Since the edge rounding machine K1 is applicable to various finished products formed with edge-rounded portions 2*a* having curved surfaces of different standards by adjusting the angle $\phi$, the pivotal angle $\alpha$, etc., the edge rounding machine is suitable for multi-kind and small quantity production.

Figure 11:
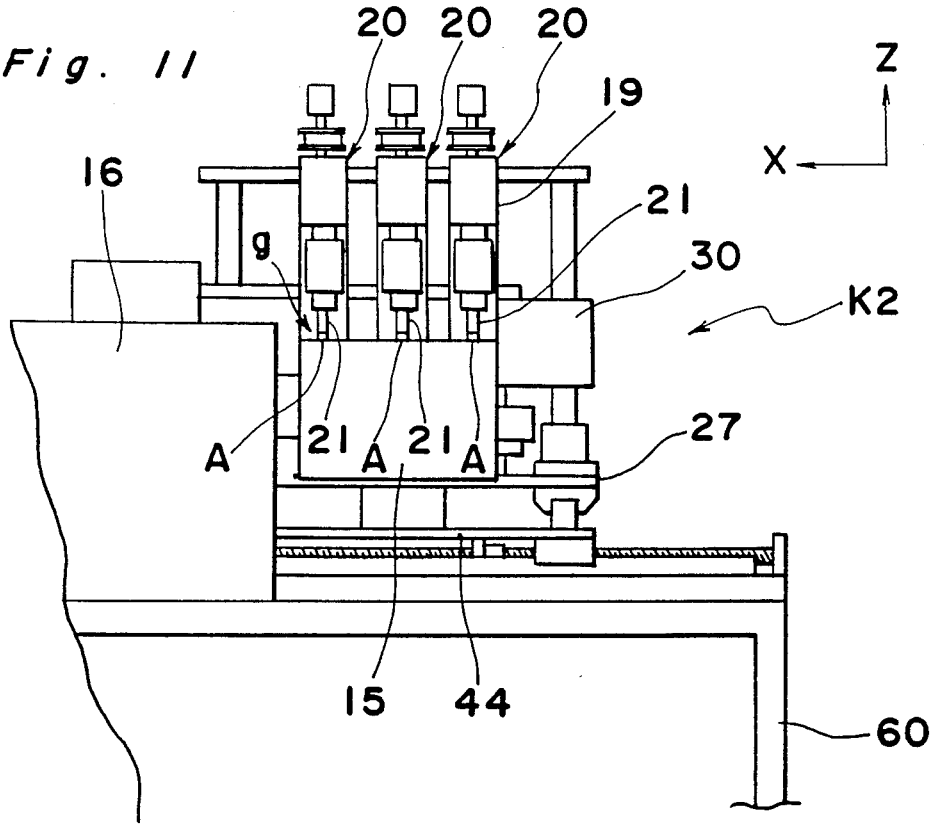
FIG. 11 is a view similar to FIG. 7, particularly showing a second embodiment of the present invention.

Referring now to FIG. 11, there is shown an edge rounding machine K2 according to a second embodiment of the present invention. In the edge rounding machine K1, only one finished product can be obtained in one cycle of the machining operation. However, in the edge rounding machine K2, since a plurality of the holder units 20 are provided at the Z-axis block 30 such that a plurality of the workpieces A are attached to a plurality of the holders 21, a plurality of the finished products can be obtained in one cycle of the machining operation. A plurality of the holders 21 are arranged in a side by side relationship with one another in parallel with the rotary axis S of the cylindrical grinding wheel 15. Thus since the workpieces A attached to the holders 21, respectively are subjected to edge rounding under an identical machining condition, the finished products of uniform quality can be obtained.

Figure 12:
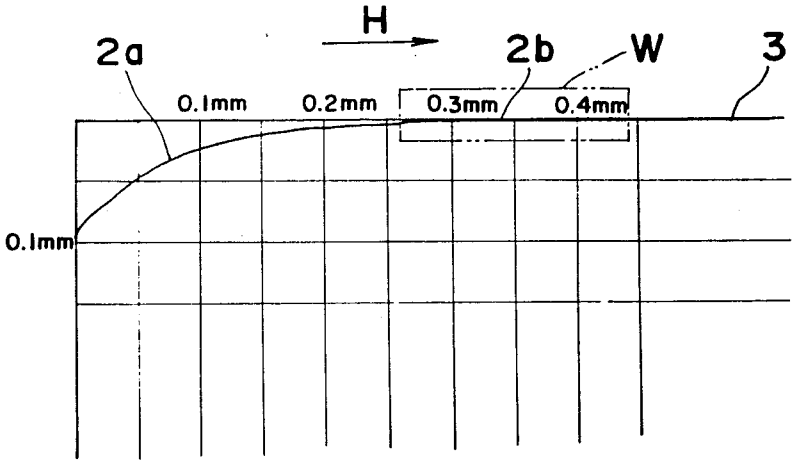
FIG. 12 is a graph indicative of a profile of an edge-rounded portion of the workpiece machined by the edge rounding machine of the present invention.

FIG. 12 shows, on an enlarged scale, a partial profile of the edge-rounded portions 2*a*, the flat portion 3 and a boundary 2*b* between the edge-rounded portion 2*a* and the flat portion 3 of the finished product obtained by the edge rounding machine of the present invention. The workpiece A is a floppy disk head shown in FIG. 1. The cylindrical grinding wheel 15 is formed by sintering diamond abrasive grains of about 5 μm in diameter with metal. In FIG. 12, the profile of the edge-rounded portion 2*a* is measured in the direction H of FIG. 1 by using a feeler type profile measuring device having a magnification of 200 in each of the ordinate and abscissa directions of FIG. 12. It will be seen from FIG. 12 that the edge-rounded portion 2*a* and the boundary 2*b* are of a smooth curved line and the boundary 2*b* smoothly connects the edge-rounded portion 2*a* and the flat portion 3. Accordingly, the workpiece A has been subjected to edge rounding of high accuracy.

Figure 13:
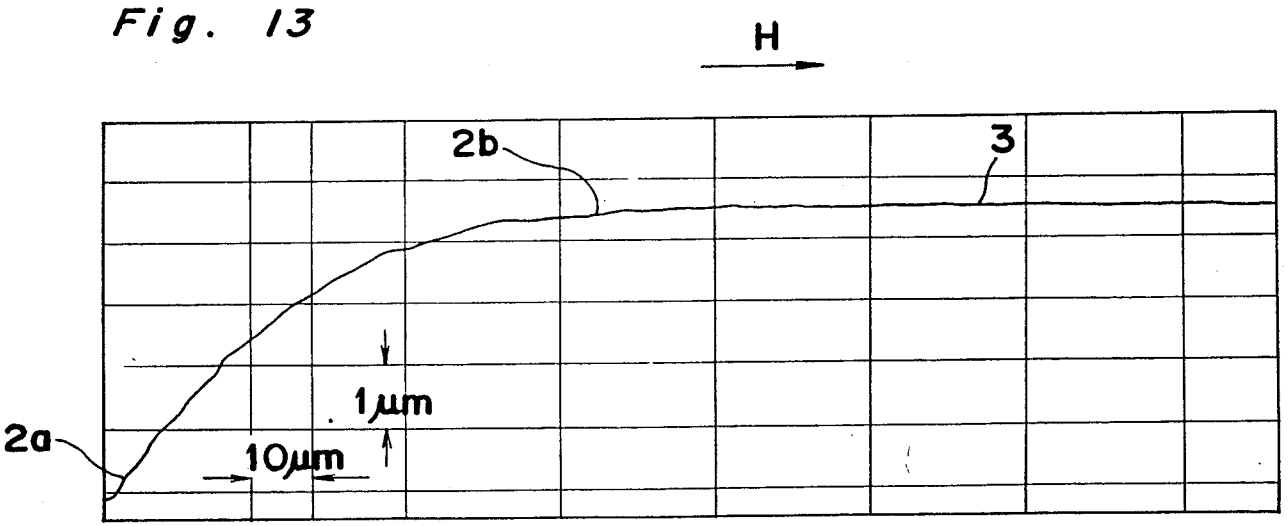
FIG. 13 is a graph indicative of surface roughness of the edge-rounded portion of FIG. 12.

FIG. 13 shows a profile of the surface in the vicinity of the boundary 2*b* (portion W in FIG. 12) measured by a feeler type surface roughness meter having a magnification of 10,000 in the ordinate direction and a magnification of 1,000 in the abscissa direction. It will be understood from FIG. 13 that a surface roughness Rmax in the vicinity of the boundary 2b is not more than 0.05 μm and an angle of inclination at the boundary 2b is minimized such that the edge-rounded portion 2a and the flat portion 3 are smoothly connected with each other at the boundary 2b.

Figure 15:
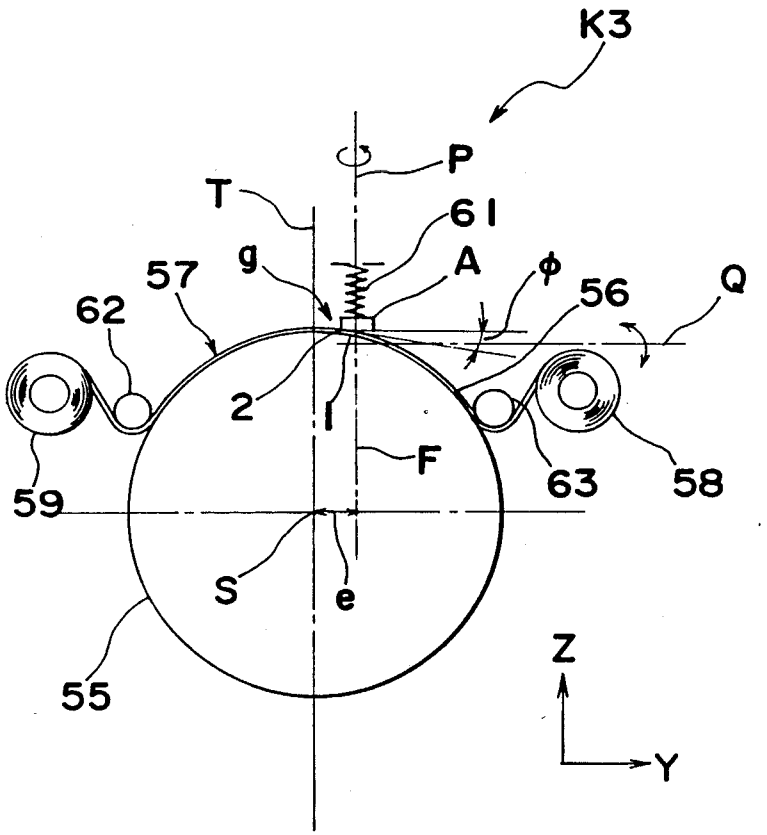
FIGS. 14 and 15 are views similar to FIGS. 9 and 10, respectively, particularly showing a third embodiment of the present invention.
Figure 14:
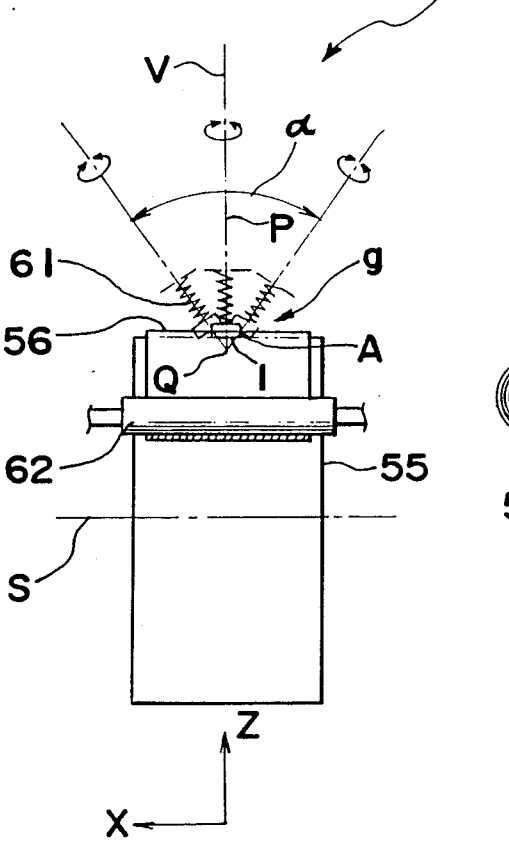

Referring further to FIGS. 14 and 15, there is shown an edge rounding machine K3 according to a third embodiment of the present invention. The edge rounding machine K3 includes a grinding tape unit 57 constituted by a rotating drum 55 and a grinding tape 56 wound around the rotating drum 55. The edge rounding machine K3 further includes a supply reel 58 for feeding the grinding tape 56 and a take-up reel 59 for receiving the grinding tape 56. The grinding tape 56 extended between the supply reel 58 and the take-up reel 59 is brought into pressing contact with an outer periphery of the rotating drum 55 by a pair of tension rollers 62 and 63. Thus, upon rotation of the rotating drum 55, the grinding tape 56 is displaced at a speed identical with a circumferential speed of the rotating drum 55. The workpiece A held by the holder 21 is brought into contact with the curved grinding face g of the grinding tape 56 so as to be subjected to edge rounding. Since machining conditions, other constructions and functions of the edge rounding machine K3 are substantially the same as those of the edge rounding machine K1 employing the cylindrical grinding wheel 15, detailed description thereof is abbreviated for the sake of brevity. The grinding tape unit 57 can also be obtained by winding the grinding tape 56 around the rotating drum 55 in the same manner as in the case of belt transmission. Furthermore, it can be also so arranged that the grinding tape unit 57 imparts a driving force to only the grinding tape 56 so as to allow the rotating drum 55 to rotate freely due to movement of the tape 56 thereon.

Figure 16:
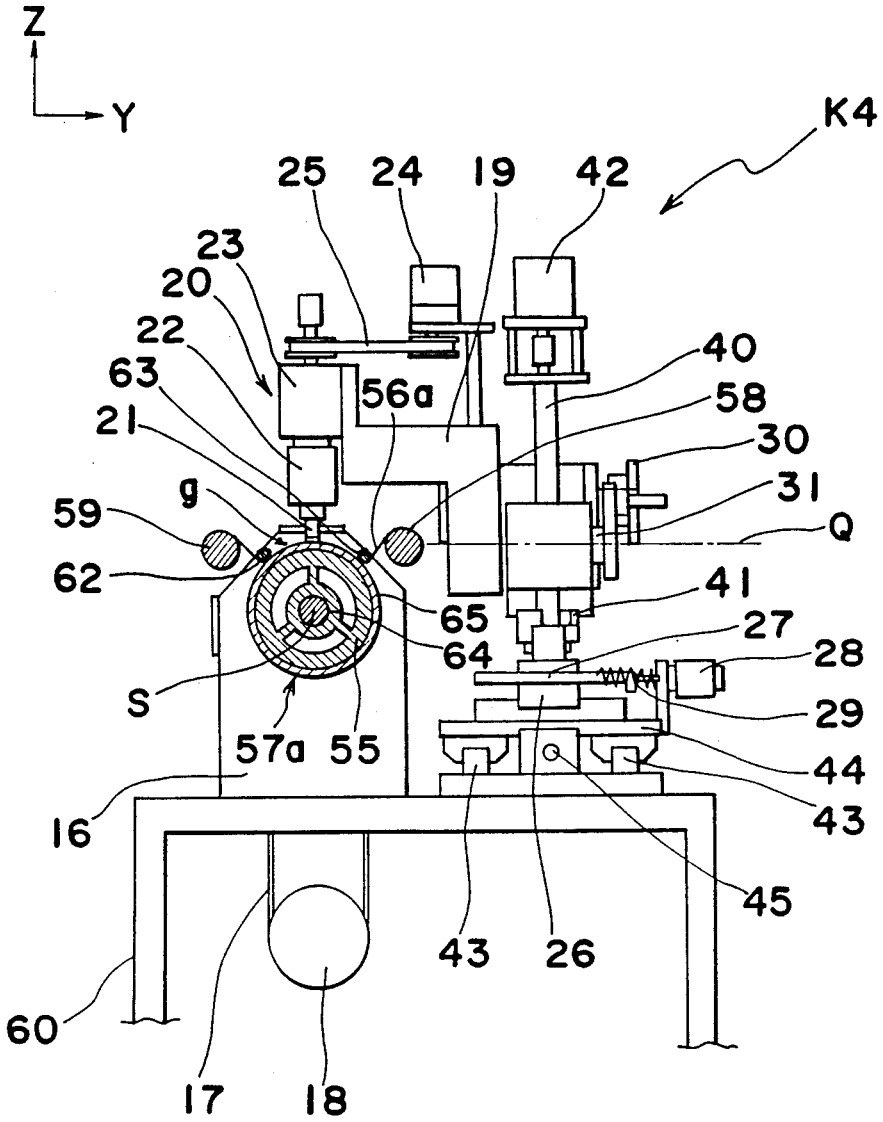
FIGS. 16, 17 and 18 are views similar to FIGS. 4, 5 and 7, respectively, particularly showing a fourth embodiment of the present invention.
Figure 17:
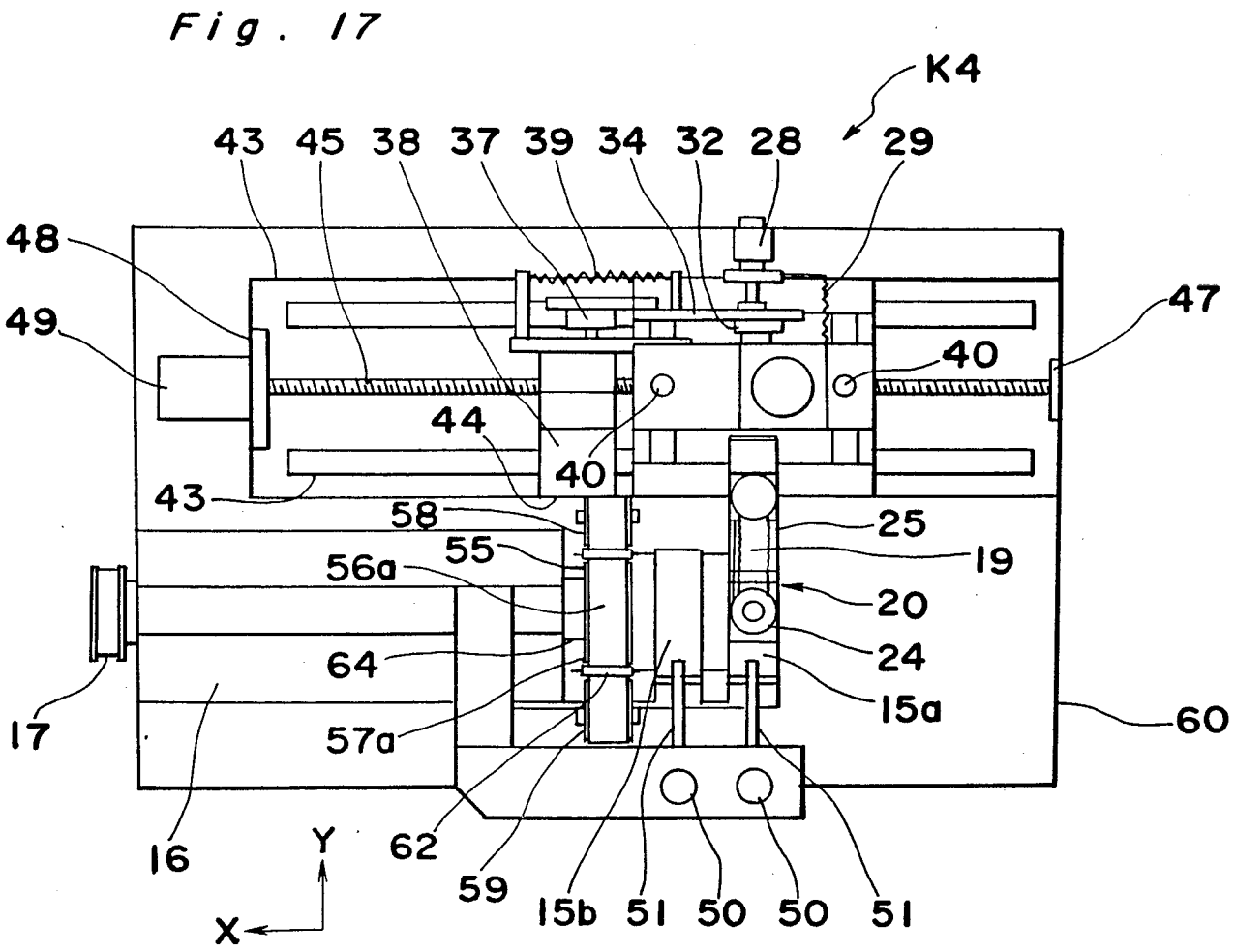
Figure 18:
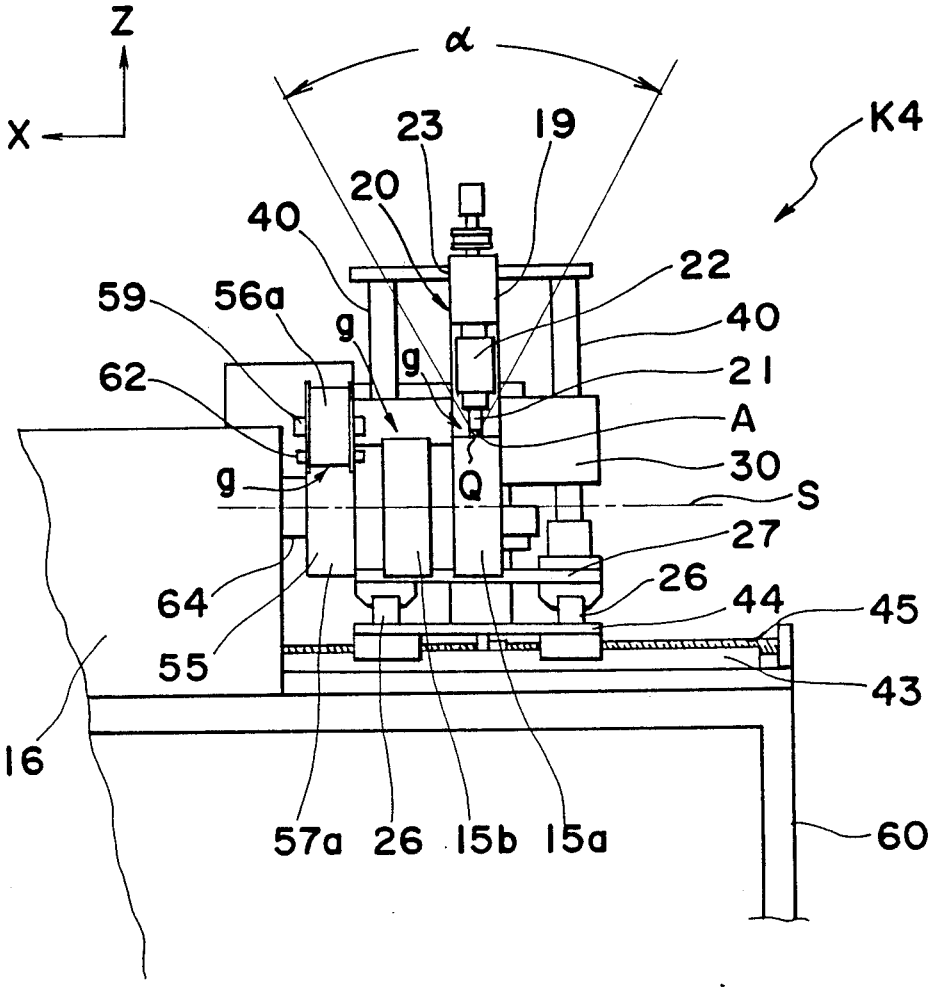

Referring finally to FIGS. 16 to 18, there is shown an edge rounding machine K4 according to a fourth embodiment of the present invention. The edge rounding machine K4 has three grinding steps, i.e., a first cylindrical grinding wheel 15a for rough machining, a second cylindrical grinding wheel 15b for main machining and a grinding tape 56a for finish machining, which are arranged at predetermined intervals along the rotary axis S. The first and second cylindrical grinding wheels 15a and 15b are arranged in the same manner as the cylindrical grinding wheel 15 shown in FIGS. 4 to 10, while the grinding tape 56a of a grinding tape unit 57a is arranged substantially in the same manner as the grinding tape 56 shown in FIGS. 14 and 15. However, the grinding tape unit 57a is different from the grinding tape unit 57 of FIGS. 14 and 15 in that an elastic sheet 65 is bonded around an outer periphery of a rotating drum 55a and that the grinding tape 56a is wound around an outer periphery of the elastic sheet 65. In the grinding tape unit 57a, heavy machining is not performed but finish machining takes place for smoothly finishing edge portions produced by rough main machining at the first cylindrical grinding wheel 15a and main machining at the second cylindrical grinding wheel 15b. The elastic sheet 65 is used for preventing the workpiece A from being scratched or cracked during the finish machining. The workpiece A is displaced in the direction of the X-axis in response to travel of the X-axis table 44. At the time when the workpiece A has been displaced in the direction of the X-axis to a first position where the workpiece A is brought into contact with the first cylindrical grinding wheel 15a, the workpiece A is subjected to rough machining by the first cylindrical grinding wheel 15a. Subsequently, when the workpiece A has been further displaced in the direction of the X-axis to a second position where the workpiece A is brought into contact with the second cylindrical grinding wheel 15b, the workpiece A is subjected to main machining by the second cylindrical grinding wheel 15b. Finally, when the workpiece A has been displaced in the direction of the X-axis to a third position where the workpiece A is brought into contact with the grinding tape 56a, the workpiece A is subjected to finish machining by the grinding tape 56a. Accordingly, in the edge rounding machine K4, three steps of the rough machining, main machining and finish machining can be performed efficiently and continuously. Furthermore, in the edge rounding machine K4, since the workpiece A is not required to be removed from the holder 21 in the course of its machining, the workpiece A can be machined with high precision.

Although the present invention has been fully described by way of example with reference to the accompanying drawings, it is to be noted here that various changes and modifications will be apparent to those skilled in the art. Therefore, unless otherwise such changes and modifications depart from the scope of the presnt invention, they should be construed as being included therein.

What is claimed is:

1. An edge rounding machine for performing edge rounding of an outer portion of a machining face of at least one workpiece, comprising:

a frame;

a cylindrical rotary member rotatably mounted on said frame for rotation about a rotary axis, said rotary member having a grinding face at its outer periphery comprising abrasive means for grinding said workpiece;

at least one holder movably supported on said frame for supporting said workpiece, means to rotate said holder about an axis of rotation which is perpendicular to the machining face of the workpiece;

support means mounted on said frame including means for adjusting said holder in horizontal and vertical directions and pivot means for pivoting said holder about a pivot axis which is perpendicular to a plane containing said rotary axis of said cylindrical rotary member;

said pivot means for pivoting said holder in a plane which contains said axis of rotation of said holder and is parallel to a plane which contains said rotary axis of said cylindrical rotary member; and a biasing means connected between said holder and said support means for biasing said holder towards said grinding face of said cylindrical rotary member so as to hold said outer edge portion of said machining face of said workpiece in contact with said grinding face at all times during machining of said workpiece.

2. An edge rounding machine as claimed in claim 1, wherein said cylindrical rotary member is a cylindrical grinding wheel.

3. An edge rounding machine as claimed in claim 1, wherein said holder supports said workpiece with the machining face of the workpiece spaced vertically from said pivot axis of said pivot means, said pivot axis being adjustable vertically with respect to said rotary axis of said cylindrical rotary member by moving said adjusting means of said support means in a vertical direction.

4. An edge rounding machine as claimed in claim 1, wherein a plurality of said holders are each mounted on a respective pivot means, each respective pivot means being mounted on said adjusting means, said plurality of holders being arranged in a side by side relationship with one another in a direction parallel to said rotary axis of said cylindrical rotary member.

5. An edge rounding machine for performing edge rounding of an outer portion of a machining face of at least one workpiece, comprising:

a frame;

a grinding tape device including a rotating drum and a grinding tape wound around said rotating drum such that said grinding tape is supported, at its inner face, by said rotating drum to provide a grinding face, said rotating drum mounted on said frame for rotation about a rotary axis;

at least one holder movably supported on said frame for supporting said workpiece, means to rotate said holder about an axis of rotation which is perpendicular to the machining face of the workpiece;

support means mounted on said frame including means for adjusting said holder in horizontal and vertical directions and pivot means for rotatably supporting said holder and for pivoting said holder about a pivot axis which is perpendicular to a phone containing said rotary axis of said rotating drum;

said pivot means for pivoting said holder in a plane which contains said axis of rotation of said holder and is parallel to a plane which contains said rotary axis of said rotating drum; and a biasing means connected between said holder and said support means for biasing said holder towards said grinding face of said grinding tape so as to hold said outer edge portion of said machining face of said workpiece in contact with said grinding face at all times during machining of said workpiece.

6. An edge rounding machine as claimed in claim 5, wherein said grinding tape device further includes an elastic sheet disposed between said rotating drum and said grinding tape.

7. An edge rounding machine as claimed in claim 5, wherein said holder supports said workpiece with the machining face of the workpiece spaced vertically from said pivot axis of said pivot means, said pivot axis being adjustable vertically with respect to said rotary axis of said rotating drum by moving said adjusting means of said support means in a vertical direction.

8. An edge rounding machine as claimed in claim 5, wherein a plurality of said holders are each mounted on a respective pivot means, each respective pivot means being mounted on said adjusting means, said plurality of holders being arranged in a side by side relationship with one another in a direction parallel to said rotary axis of said rotating drum.

* * * * *